US010138011B2

(12) United States Patent
Ruissen et al.

(10) Patent No.: US 10,138,011 B2
(45) Date of Patent: Nov. 27, 2018

(54) FILLING DEVICE AND METHOD FOR FILLING A CONTAINER WITH PRODUCTS FLOATING AND/OR SUSPENDED IN AN AQUEOUS LIQUID

(71) Applicant: De Greef's Wagen-, Carrosserie- en Machinebouw B.V., Tricht (NL)

(72) Inventors: Hendrik Krijn Ruissen, Tricht (NL); Arjen Johannes Wilhelmus Van Kleef, Tricht (NL); Hendrik Jan Van Ooijen, Tricht (NL)

(73) Assignee: De Greef's Wagen-, Carrosserie-en Machinebouw B.V., Tricht (NL)

( * ) Notice: Subject to any disclaimer, the term of this patent is extended or adjusted under 35 U.S.C. 154(b) by 374 days.

(21) Appl. No.: 14/913,697

(22) PCT Filed: Sep. 2, 2014

(86) PCT No.: PCT/NL2014/050597
§ 371 (c)(1),
(2) Date: Feb. 23, 2016

(87) PCT Pub. No.: WO2015/030595
PCT Pub. Date: Mar. 5, 2015

(65) Prior Publication Data

US 2016/0200468 A1 Jul. 14, 2016

(30) Foreign Application Priority Data

Sep. 2, 2013 (NL) ..... 2011366
Dec. 6, 2013 (NL) ..... 2011910

(51) Int. Cl.
*B65B 25/04* (2006.01)
*B65B 3/04* (2006.01)
(Continued)

(52) U.S. Cl.
CPC ..... *B65B 25/045* (2013.01); *B65B 3/04* (2013.01); *B65B 31/00* (2013.01); *B65B 39/007* (2013.01)

(58) Field of Classification Search
CPC ..... B65B 25/045; B65B 3/04; B65B 31/00; B65B 39/007; B65B 69/00; B65G 53/02;
(Continued)

(56) References Cited

U.S. PATENT DOCUMENTS 3,470,670 A 10/1969 Gorin
3,656,272 A 4/1972 Sheetz
(Continued)

FOREIGN PATENT DOCUMENTS

GB 1571400 A * 7/1980 ..... B65B 25/045
NL 7514869 A 6/1977

*Primary Examiner* — David Walczak
(74) *Attorney, Agent, or Firm* — The Webb Law Firm

(57) ABSTRACT

A filling device and method for filling a container with floating and/or suspended products, in particular for apples and pears. The device has a frame provided with a supply tank fillable with aqueous liquid, and a vacuum chamber for realizing an underpressure in at least a part of the supply tank; immersion means operatively connected to the frame for the purpose of placing the container into or removing the container from the supply tank; and feeder for feeding to the supply tank the aqueous liquid in which the floating and/or suspended products are entrainable. The feeder includes a flow tube or flow channel with which the floating and/or suspended products are carriable into the vacuum chamber.

18 Claims, 4 Drawing Sheets

(51) Int. Cl.
*B65B 31/00* (2006.01)
*B65B 39/00* (2006.01)

(58) Field of Classification Search
CPC ..... B65G 53/66; B65G 65/005; B65G 65/23; B65G 2201/06; B65G 53/32; B65G 2201/047; B65G 2203/0266; B65G 51/01
See application file for complete search history.

(56) References Cited

U.S. PATENT DOCUMENTS

| | | | | |
|---|---|---|---|---|
| 3,786,917 | A | 1/1974 | Rousselie et al. | |
| 5,242,250 | A * | 9/1993 | Compagnoni | B65B 25/045 141/70 |
| 7,159,373 | B2 * | 1/2007 | Blanc | B65B 25/045 53/244 |
| 9,073,707 | B2 * | 7/2015 | Ruissen | B65G 51/01 |
| 9,809,400 | B2 * | 11/2017 | Eberle | B65B 69/00 |

* cited by examiner

FILLING DEVICE AND METHOD FOR FILLING A CONTAINER WITH PRODUCTS FLOATING AND/OR SUSPENDED IN AN AQUEOUS LIQUID

CROSS-REFERENCE TO RELATED APPLICATIONS

This application is the United States national phase of International Application No. PCT/NL2014/050597 filed Sep. 2, 2014, and claims priority to Netherlands Patent Application Nos. 2011366 and 2011910 filed Sep. 2, 2013, and Dec. 6, 2013, respectively, the disclosures of which are hereby incorporated in their entirety by reference.

BACKGROUND OF THE INVENTION

Field of the Invention

The present invention relates to a filling device for filling a container particularly with products floating or suspended in an aqueous liquid such as water. These products are more particularly vulnerable products, which in the context of the invention are in particular fresh products, more particularly fruit susceptible to damage during handling thereof, including apples, pears and tomatoes.

Description of Related Art

Floating products are products which float in such an aqueous liquid and therefore have a density substantially lower than that of the aqueous liquid, such as apples. Suspended products are products which are suspended in such an aqueous liquid and therefore have a density roughly equal to that of the aqueous liquid, such as pears.

Known filling devices fill a container by supplying products in a water flow to a container immersed in water, wherein the products are urged into the container by the flow. A considerable flow has to be provided here, particularly once a significant part of the container has been filled. This results in a risk of damage to vulnerable products in particular, such as apples.

Likewise known in practice are the filling devices wherein use is made of a so-called vacuum chamber, wherein products are carried into a container using an underpressure. This underpressure is realized such that the products can be carried under this vacuum chamber. After sufficient products have been collected in the vacuum chamber the container is lifted, the underpressure released, and the products move into the container. A drawback of such filling devices is the relatively great underpressure which has to be applied to enable buffering of sufficient products in the vacuum chamber. When the underpressure is released this results in quite a large water displacement, whereby the products can on the one hand bump against each other, resulting in considerable damage, and a kind of shockwave is on the other hand carried back in the direction of the feed with the feed channel due to the water displacement. Such a feed channel must therefore be provided with provisions for absorbing such shockwaves, including extra material in the form of higher upright edges and the like.

A further problem of known filling devices with a vacuum chamber is that this chamber works only for products, such as apples, floating in an aqueous liquid. Suspended products, i.e. products having roughly the same density as the water flow, such as pears, cannot be processed, or at least not properly, with such filling devices.

The object of the present invention is to provide a device for filling containers with products such that damage to these products is avoided and the above stated problems are further obviated or at least reduced.

SUMMARY OF THE INVENION

The present invention provides for this purpose a filling device for filling a container according to the invention with products floating and/or suspended in an aqueous liquid, the filling device comprising:

- a frame provided with a supply tank fillable with the aqueous liquid, and a vacuum chamber for realizing an underpressure in at least a part of the supply tank;
- immersion means operatively connected to the frame for the purpose of placing the container into or removing it from the supply tank;
- feed means for feeding to the supply tank the aqueous liquid in which the floating and/or suspended products are entrainable, wherein the feed means comprise a flow tube or flow channel with which the floating and/or suspended products are carriable into the vacuum chamber.

An aqueous liquid is in practice usually water with the components optionally present therein for processing of products. Such products are particularly vulnerable products such as apples, pears and tomatoes. Apples usually form a category of floating products here since they usually have a lower density than the water, and the pears form a category of suspended products since they have a density roughly equal to that of water.

The products for processing are carried into a container, particularly a crate, using the filling device. Providing a frame of the filling device with a supply tank, in which a container is placeable, and a vacuum chamber makes it possible to realize an underpressure at the position of a container placed in a supply tank. The water level at the position of the container will hereby preferably be slightly higher than the water level of a feed channel with which the products are being transported to the filling device. In the context of the present invention water level is likewise understood to mean the level of the aqueous liquid Immersion means provide for placing of the container into or its removal from the supply tank, wherein the vacuum chamber and the container are preferably displaceable relative to the supply tank.

Products are carried to the supply tank using feed means. Use is preferably made here of a feed channel which for instance forms a connection between a sorting device and the filling device according to the invention. Sorted products can in this way be carried in automatic manner into a container for further transport.

According to the invention the feed means comprise a flow tube or flow channel with which the floating and/or suspended products are carriable into the vacuum chamber. Such a tube or channel comprises any guide with which these products are carriable into the vacuum chamber, including tubes, box profiles, square guides, semicircular tubes and so on. The flow tube or flow channel makes use of the flow in for instance a feed channel in order to thereby carry the products into the vacuum chamber. This achieves that a conveyor belt is not necessary to carry the products from a feed channel into the vacuum chamber or place them in a container.

The use of the flow tube or flow channel according to the invention has the advantage that a small working height can suffice for the vacuum chamber, particularly a lower water level in the vacuum chamber. This has the result that, when an underpressure realized in the vacuum chamber is released, smaller height differences have to be spanned, whereby products are less likely to collide and less damage will occur.

An additional effect is that because of the lower water level a smaller water displacement will occur, whereby a shockwave which is carried back through the feed channel is substantially avoided. On the one hand this limits possible damage to the products in such a feed channel and avoids having to make additional provisions in such feed channels, such as relatively high side walls, in order to avoid flooding as a result of such a shockwave. A filling processes is hereby provided whereby the quality of the products can be maintained and which can be performed in effective manner.

The container in the filling device according to the invention preferably comprises a crate with the opening facing upward during use. This avoids a tilting mechanism being required for such a container with which a relatively complex movement of the container is necessary during placing into or removal from the supply tank. With the filling device according to the invention a relatively simple construction can therefore suffice. This shortens the processing time, wherein no complex movements of the container are necessary during placing into or removal from the supply tank, and additionally limits the amount of equipment required since a tilting mechanism is not necessary.

The flow tube or flow channel preferably forms a connection between a feed channel and the vacuum chamber, wherein the flow tube or flow channel is located wholly outside the interior of the container during use. Products are carried from the feed channel into the vacuum chamber via this connection as a result of the flow of the aqueous liquid. An entry opening of the flow tube or flow channel is preferably arranged here in or on the feed channel, while the exit opening of the flow tube or flow channel is arranged in or on the supply tank. The flow tube or flow channel therefore remains outside the interior of the container. The liquid with the products is hereby carried by the liquid flow from the feed channel to the supply tank, and in particular to the vacuum chamber therein, such that the products are carriable into the container.

In an advantageous preferred embodiment according to the present invention the exit opening of the flow tube or flow channel is located close to or against the vacuum chamber during use.

Positioning the exit opening of the flow tube or flow channel close to or against the vacuum chamber during use achieves that products can be carried into the vacuum chamber without the flow tube or flow channel having to extend into or under this vacuum chamber. Use is made here of the flow in the flow tube or flow channel. This flow is optionally reinforced or accelerated. Because the tube or the channel remains outside the interior of the container, the relative positioning of the container in the supply tank and the vacuum chamber can be performed more easily here without a flow tube or flow channel having to undergo a significant movement or displacement. In conventional filling devices a conveyor belt has to be repositioned for every container. This extends the processing time, whereby the overall capacity of the filling device is reduced. In the filling device according to the present invention the processing time is in contrast shortened by the simple and quicker placing of containers and vacuum chamber without (re) positioning of the feed means.

An additional advantage of connecting the exit opening of the flow tube or flow channel close to or against the vacuum chamber during use is that the vacuum chamber can correspond to the container, and the device as a whole can therefore be provided with a lower working height. This has the result, among others, that the same quantity of products can be buffered in the vacuum chamber with a smaller increase of the liquid level therein. This adds to the above stated advantages in respect of product damage and liquid displacement.

The good connection of the flow tube or flow channel to the vacuum chamber achieves that suspended products in particular, such as pears, cannot disperse through the supply tank and for instance end up outside the vacuum chamber. Loss of products is hereby prevented. Also avoided is that such products which have come to rest in the wrong location can foul the construction of the filling device. Owing to this connection the filling device is not only suitable for floating products such as apples, but also for suspended products such as pears. This enables flexible deployment of the filling device according to the invention, whereby an effective filling device according to the invention is obtained.

In an advantageous preferred embodiment according to the present invention the vacuum chamber is provided on a side oriented laterally during use with a feed opening to which the flow tube or flow channel is operatively connectable.

The products can be carried into the vacuum chamber in effective manner by providing the vacuum chamber with a feed opening to which the flow tube or flow channel is operatively connected during use. This avoids the flow tube having to be positioned under the vacuum chamber. This further achieves that the vacuum chamber can be positioned a shorter distance from the container during the filling process. The vacuum chamber is preferably connected to this container. The water level is hereby further reduced, resulting in the above stated effects of less risk of product damage and a smaller water displacement when the underpressure is released. Providing a filling opening preferably on the side wall of the vacuum chamber enables the liquid flow with the products to be carried into the vacuum chamber with a slight deflection of the flow path. The chance of mutual collisions between the products is hereby avoided. The products will also make less contact with the wall of the flow tube or flow channel. This wall is preferably further provided with material which prevents damage to products.

In an advantageous preferred embodiment according to the present invention the filling device comprises a feed channel in which a flow accelerator is provided.

By providing a feed channel the liquid with the products is fed from for instance a sorting device to the filling device according to the invention. Providing a flow accelerator herein, preferably close to an outer end of the feed channel, achieves that the speed of the flow increases, whereby products are carried at a somewhat increased speed into the flow tube or flow channel and are positioned in the vacuum chamber by the flow in effective manner A flow tube or flow channel hereby need not extend into the interior of the container during use of the device. The feed of products and distribution thereof in the container is further improved by accelerating the flow. Such a flow accelerator is for instance provided as a kind of threshold arranged on the bottom of the feed channel. Other embodiments of flow accelerators are likewise possible.

The flow accelerator preferably comprises an additional liquid supply, preferably at or close to the underside of the flow accelerator. This achieves that products are carried into the chamber more quickly and with fewer collisions.

In an advantageous preferred embodiment according to the present invention the vacuum chamber is also provided with throughflow openings.

Providing throughflow openings enables the liquid with which the products are fed via the flow tube or flow channel to be discharged through the vacuum chamber while the products remain present in the vacuum chamber. A better throughflow of the vacuum chamber is hereby created, whereby a better distribution of the products over the vacuum chamber is realized. This also creates a gentler flow in the vacuum chamber, so that products will collide with each other less and damage is further prevented.

At least some of these throughflow openings are preferably provided on the side of the vacuum chamber oriented laterally during use and lying opposite the side in which the feed opening is provided. A good throughflow of the vacuum chamber is hereby provided. This results in a further improved distribution of products over the vacuum chamber.

In a further advantageous preferred embodiment according to the present invention the filling device comprises a bypass conduit for throughflow of an aqueous liquid during placing of the container.

By providing a bypass conduit the liquid flow can be maintained when a container is introduced into the supply tank or the container is removed from the supply tank. It is hereby unnecessary to start up the flow again for each new container, and the processing capacity of the filling device according to the present invention is increased significantly relative to conventional filling devices. It has been found that such a bypass operates particularly advantageously in combination with the fact that the flow tube or flow channel according to the invention need not be positioned under or in the vacuum chamber. This results in an additional great reduction in the processing time needed to fill a single container. In a currently preferred embodiment the bypass provides a valve close to an outer end of a feed channel which can be switched, after which the liquid flow is deflected. Products are preferably obstructed upstream, for instance with a grating, so that products are not lost. An effective operation of the filling device is hereby achieved.

In an advantageous preferred embodiment according to the invention the filling device further comprises a level sensor arranged in or close to the feed means.

Variations in the water level in the feed means, such as in the feed channel, may occur during use. This may cause problems during use, for instance due to loss of vacuum/underpressure in the chamber. This can have an adverse effect on, among other things, the capacity of the filling device. Measuring the level in the feed means makes it possible to correct the device herefor, for instance with an extra inflow, a greater or smaller flow via the feed means and/or by changing the position of valves in the feed means.

In a current embodiment according to the invention the level sensor is preferably connected operatively to height adjusting means of the vacuum chamber. The level sensor measures the level in the channel or other type of feed means. On the basis of this measurement the height of the chamber can be adjusted using the height adjusting means in order to allow the filling with products to take place optimally. It is hereby possible to allow the chamber to co-displace with the height measured in the feed means.

The present invention further relates to a sorting line provided with a filling device as described above and/or a method for filling a container with floating and/or suspended products, the method comprising the steps of:

providing a filling device as described above;

placing the container in the supply tank using the immersing means;

feeding the products using an aqueous liquid;

carrying the products into the vacuum chamber using the flow tube or flow channel; and removing the container from the supply tank using the immersing means.

Such a sorting line and/or method provide the same effects and advantages as described for the filling device. It has been found particularly that by applying the method according to the invention damage to the product can be avoided and a relatively simple construction can additionally be provided for the filling device, wherein few additional provisions need further be provided in order to deal with water displacements during use of the filling device. Preferably maintaining the supply of a liquid flow during removal of the container from the supply tank achieves that fluctuations and waves in the water level are prevented.

In a currently preferred embodiment according to the invention the sorting line is provided with an entrance gate, also referred to as basic gate, for opening and wholly or partially closing the entry from the feed channel to the filling device. The products are hereby supplied groupwise to the filling device at the desired moment. An effective filling is hereby possible. The sorting line according to the invention is preferably also provided with an additional gate for the purpose of pre-grouping a subsequent group of products. Collecting products into a group hereby becomes more effective, and such a group can be carried to the filling device in effective manner at the desired moment by controlling the entrance gate and additional gate. Both gates are preferably provided in the feed means, in particular in the feed channel. The gates can be embodied in different ways, for instance as a partition, plate, grating, grill and so on.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION OF THE INVENTION

Figure 1:
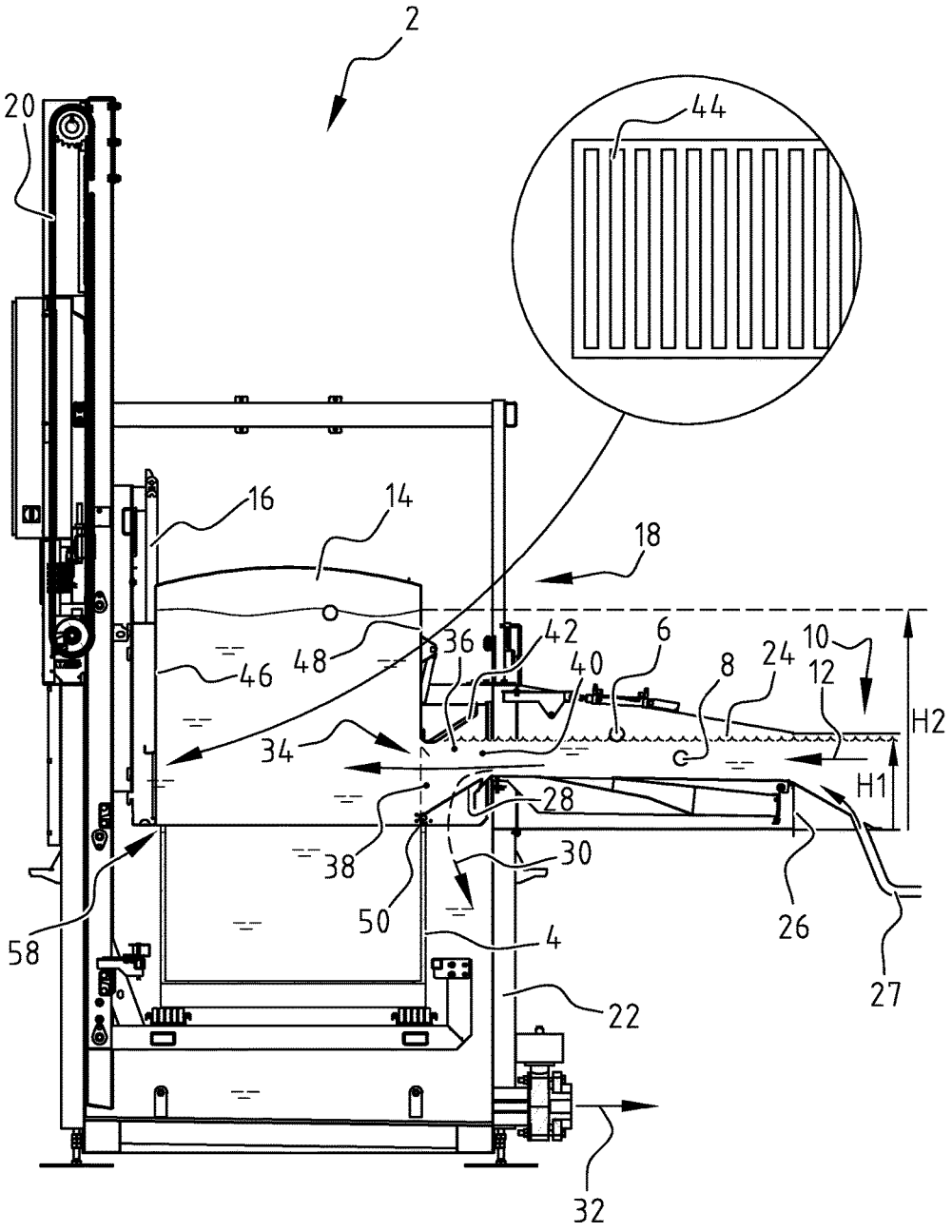
FIG. 1 shows a view of a filling device according to the invention.

Filling device 2 (FIG. 1) fills crate 4 with floating products 6 and/or suspended products 8 which are supplied through feed channel 10 using water flow 12. Vacuum chamber 14 can be adjusted in the height relative to frame 18 of device 2 using lifting mechanism 16. Device 2 is further provided with lifting means 20 for placing crate 4 in supply tank 22 of device 2 and removing crate 4 after filling thereof from tank 22.

Feed channel 10 is provided with side walls 24 and a flow accelerator 26 which is embodied in the shown embodiment as a kind of threshold. The shown flow accelerator is provided with additional water supply 27 for increasing the product speed and realizing a flow whereby the chance of collisions is reduced.

Bypass valve 28 determines whether flow 12 continues to chamber 14 or is diverted via bypass 30 and fed back into the process via return flow 32. In the shown embodiment channel 10 is provided with a water height H1 during use. Chamber 14 is provided in use with a water height H2 greater than height H1 during application of an underpressure. Chamber 14 is further provided with feed opening 34 on or against which flow tube or flow channel 36 is placed with exit opening 38 during use. Entry opening 40 is connected to channel 10 on the other side of tube or channel 36. It will be apparent that tube or channel 36 can be embodied in diverse ways, for instance as tube, duct, guide as alternative or in addition to the shown embodiment, wherein valve 28 with optional guide 42 forms tube or channel 36.

In the shown embodiment chamber 14 is provided with throughflow openings 44 in wall 46 of chamber 14 lying opposite wall 48 of chamber 14 in which feed opening 34 is provided. In the shown embodiment valve 28 is rotatable around rotation shaft 50.

In the shown embodiment the length of filling device 2 is about 1000 mm, width about 950 mm and height about 500 mm. This height is therefore considerably lower, by a factor 2, than in conventional filling devices. In the shown embodiment the volume of chamber 14 is about 475 liters, likewise a factor 2 smaller than in similar conventional filling devices. This results in a significant reduction in working heights and water displacements in the use of device 2 according to the invention.

Figure 2:
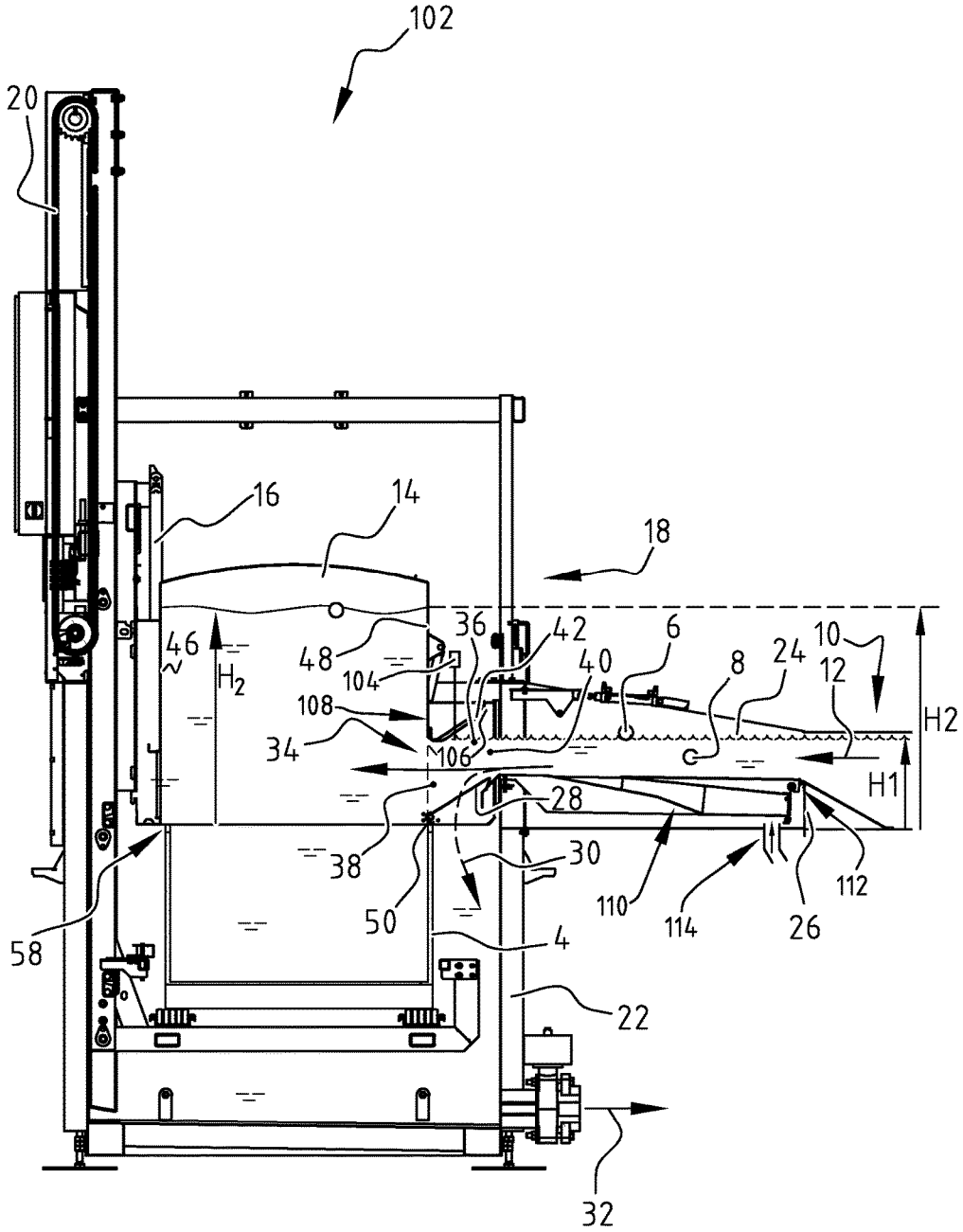
FIG. 2 shows a view of an alternative filling device according to the invention.

Largely the same or similar elements as in the filling device 2 discussed above are applied in an alternative filling device 102 (FIG. 2). These elements are therefore designated with the same reference numerals. Products 6, 8 are carried along by flow 12 under inflow plate 42 and into chamber 14. Variations in water level H1 may occur in channel 10 during use. This may cause problems during use, for instance through loss of vacuum/underpressure in chamber 14 and/or products 6, 8 having to be carried too far under plate 42, which has an effect on, among other things, the capacity of filling device 102.

Level sensor 104 measures level H1 in channel 10. On the basis of this measurement the height of chamber 14 can be adjusted to allow filling with products 6, 8 to take place as optimally as possible. It is hereby possible to allow the chamber 14 to co-displace with the height H1 measured in channel 10.

Level H1 in channel 10 can optionally be adjusted on the basis of the measurement by sensor 104 by increasing or decreasing flow 12 and/or optionally changing the position of plate 42. When the position of plate 42 is changed it is rotated around rotation point 106, wherein the rotation is realized in that chamber 14 presses against stop 108 of plate 42. In the shown embodiment the pressing force of chamber 14 is greater than the standard set spring pressure, so that the movements of chamber 14 and plate 42 are adapted to each other. Stop 108 is preferably provided in adjustable manner. Alternatively or additionally to plate 42, inflow plate 110 can also be rotated around a rotation shaft 112 as a result of the pressing force of chamber 14 against a stop of plate 110 with a force greater than the standard set spring pressure. The same advantages are hereby achieved as with movement of plate 42, or these advantages are further reinforced.

An extra water flow can further be provided in the shown embodiment via inlet 27 (FIG. 1) or inlet 114 (FIG. 2). Use is optionally made of one or more frequency-controlled pumps for feed of water/liquid in order to realize the best possible relative matching of the flows. This makes it possible to deal with variations in speeds and height levels occurring in practice. It will be apparent that the stated measure of the chamber variable that is in height and the flow adjusting measures can also be combined.

Figure 3:
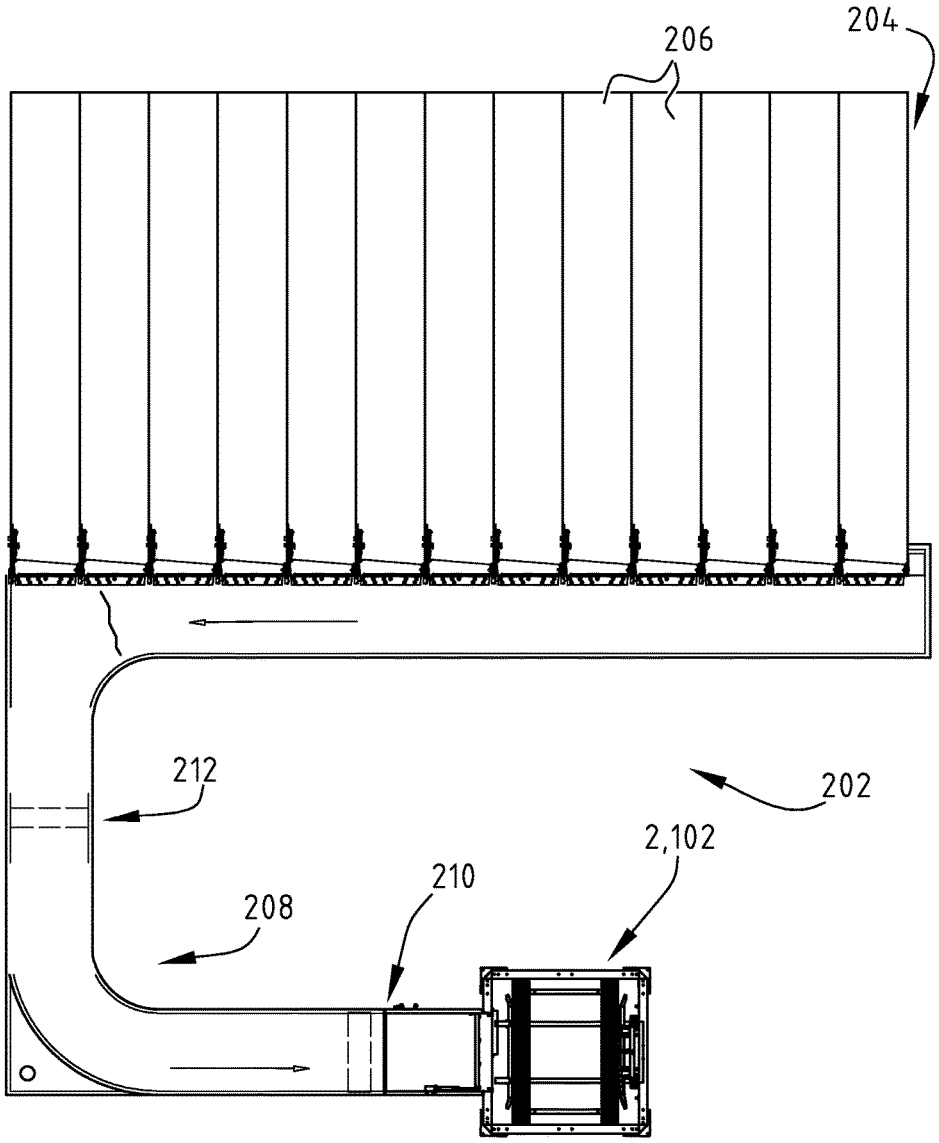
FIG. 3 shows a view of an installation provided with a filling device according to FIG. 1 or 2.

In a process installation 202 (FIG. 3) products 6, 8 are carried from buffering device 204 with a number of buffer channels 206 via channel system 208 to filling device 2, 102. Basic gate 210 is present in channel system 208. After gate 210 is opened a batch/group/filling of products 6, 8 enters filling device 2, 102. In the shown embodiment an additional gate 212 is also provided for collecting the subsequent filling of products 6, 8. A product detector is optionally provided in channel system 208 for the purpose of detecting the quantity of products which have passed by in order to then change the position of gate 210 and/or gate 212. This can further increase the effectiveness of the filling process.

Figure 4:
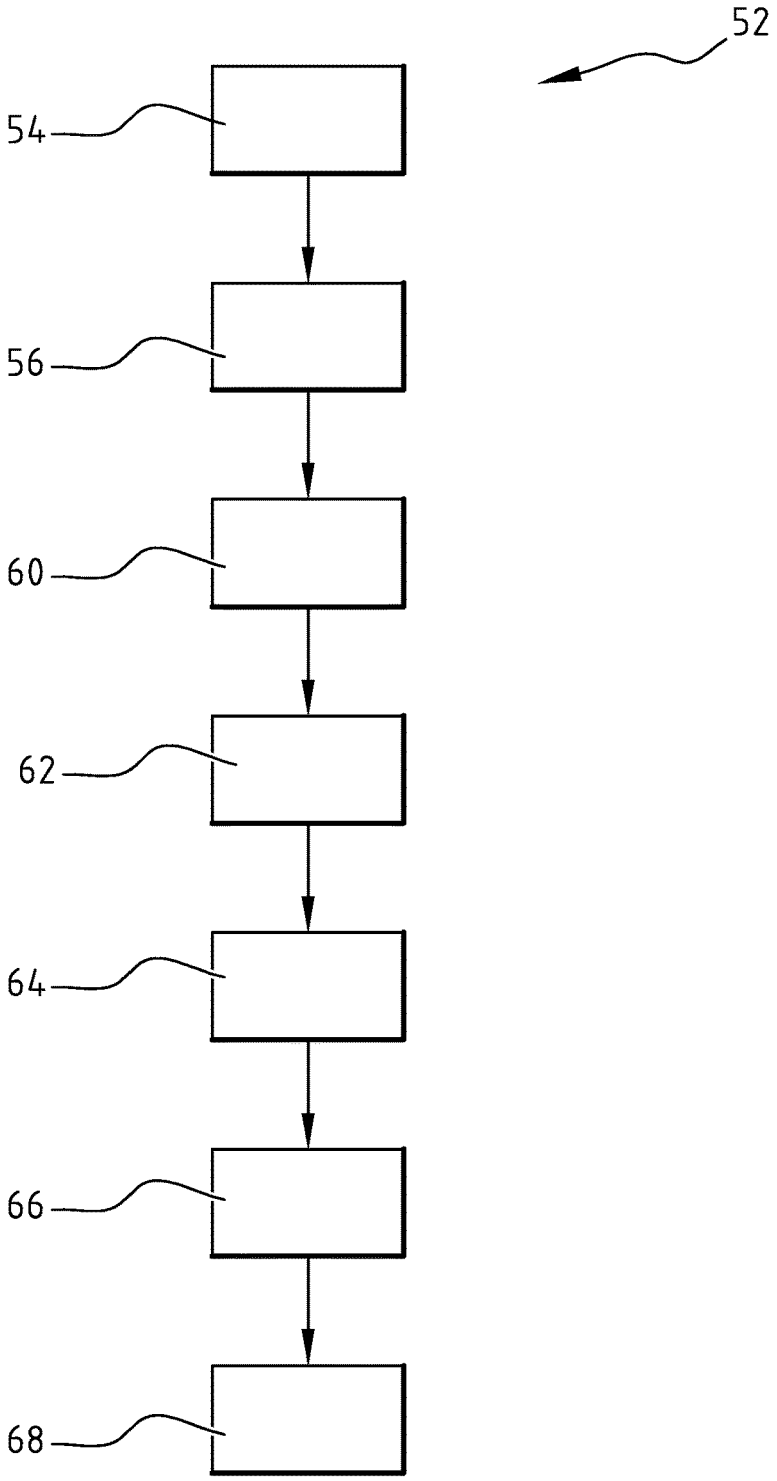
FIG. 4 shows a schematic representation of the operation of the filling device of FIG. 1.

During use the process 52 (FIG. 4) starts in first initiation step 54 with lifting means 20 with which a crate 4 is picked up and placed on or at chamber 14. In second initiation step 56 chamber 14 with crate 4 is placed in tank 22. The working height of device 2 is hereby limited, and no suspended products 8 can "escape". Initiation steps 54, 56 can otherwise also be performed wholly or partially simultaneously, or in reverse order.

In activation step 60 an underpressure is then applied in chamber 14, and flow 12 with products 6, 8 is started, wherein valve 28 is brought into the filling position. In this position flow 12 carries products 6, 8 into chamber 14.

Products 6, 8 are carried into chamber 14 during filling process 62. Floating products 6 will move in the direction of the water surface at height H2 and suspended products 8 will continue to move in chamber 14 or crate 4. Flow 12 feeds products 6, 8 to chamber 14 and the water leaves chamber 14 via throughflow openings 44 for a return flow.

Once sufficient products 6, 8 have been carried into chamber 14 and/or crate 4, valve 28 is brought into the bypass position in closing step 64, wherein flow 30 preferably circulates the water via return flow 32.

In removal step 66 the underpressure in chamber 14 is released and water height H2 will become equal to height H1 in channel 10, and chamber 14 and crate 4 are removed from tank 22.

Crate 4 with products 6, 8 is further transported and/or processed in processing step 68.

The present invention is by no means limited to the above described preferred embodiments thereof. The rights sought are defined by the following claims, within the scope of which many modifications can be envisaged.

The invention claimed is:

1. A filling device for filling a container with products floating and/or suspended in an aqueous liquid, the filling device comprising:

a frame provided with a supply tank fillable with the aqueous liquid, and a vacuum chamber for realizing an underpressure in at least a part of the supply tank;

a lift connected to the frame for the purpose of placing the container into or removing the container from the supply tank;

a feeder configured to feed to the supply tank the aqueous liquid in which the floating and/or suspended products are entrainable, wherein the feeder comprise a flow tube or flow channel with which the floating and/or suspended products are carriable into the vacuum chamber;

wherein the vacuum chamber is provided with throughflow openings; and wherein at least some of the throughflow openings are provided on a side of the vacuum chamber oriented laterally during use and lying opposite a side in which a feed opening is provided.

2. The filling device of claim 1, wherein the flow tube or flow channel forms a connection between a feed channel and the vacuum chamber, wherein the flow tube or flow channel is located wholly outside the interior of the container during use.

3. The filling device of claim 2, wherein the flow tube or flow channel comprises an entry opening placed during use in or on the feed channel and an exit opening placed during use in or on the supply tank.

4. The filling device of claim 3, wherein the exit opening of the flow tube or flow channel is located close to or against the vacuum chamber during use.

5. The filling device as claimed in claim 1, wherein the vacuum chamber is provided on a side oriented laterally during use with a feed opening to which the flow tube or flow channel is operatively connectable.

6. The filling device as claimed in claim 1, wherein the vacuum chamber is adapted to be connected to the container during filling.

7. The filling device as claimed in claim 1, further comprising a feed channel in which a flow accelerator is provided.

8. The filling device as claimed in claim 7, wherein the flow accelerator comprises an additional liquid supply.

9. The filling device as claimed in claim 1, further comprising a bypass conduit for throughflow of the aqueous liquid during placing of the container.

10. The filling device as claimed in claim 1, further comprising a level sensor arranged in or close to the feeder.

11. The filling device as claimed in claim 10, wherein the level sensor is connected operatively to a height adjuster of the vacuum chamber.

12. A sorting device comprising a line and a filling device as claimed in claim 1.

13. The sorting device of claim 12, wherein the line further comprises an entrance gate configured for group wise admittance of products to the filling device.

14. The sorting device of claim 13, wherein the line further comprises an additional gate for the purpose of pre-grouping products.

15. A method for filling a container with floating and/or suspended products, comprising the steps of:

providing a filling device of claim 1;

placing the container in the supply tank using the lift;

feeding the products using an aqueous liquid;

carrying the products into the vacuum chamber using the flow tube or flow channel; and removing the container from the supply tank using the lift.

16. The method as claimed in claim 15, wherein the supply of a liquid flow is maintained during removal of the container from the supply tank.

17. The filling device of claim 1, further comprising a bypass conduit for throughflow of the aqueous liquid during placing of the container.

18. The filling device of claim 1, wherein the vacuum chamber is provided on a side oriented laterally during use with a feed opening to which the flow tube or flow channel is operatively connectable.

* * * * *